United States Patent [19]

Lowe

[11] Patent Number: 4,660,322

[45] Date of Patent: Apr. 28, 1987

[54] REVOLVING DOOR

[76] Inventor: Dennis Lowe, Canada Post Corp., 4245 Sheppard Ave. E., Agincourt, Ont., Canada, M1S 1T5

[21] Appl. No.: 754,813

[22] Filed: Jul. 12, 1985

[30] Foreign Application Priority Data

Jul. 27, 1984 [CA] Canada ..... 459846

[51] Int. Cl.[4] ..... E05D 15/02

[52] U.S. Cl. ..... 49/44

[58] Field of Search ..... 49/42, 44, 45

[56] References Cited

U.S. PATENT DOCUMENTS

| | | | |
|---|---|---|---|
| 1,963,881 | 6/1934 | Blanchard | 49/44 |
| 2,043,780 | 6/1936 | Simpson | 20/18 |
| 2,537,418 | 1/1951 | Nordin | 49/44 |
| 2,539,750 | 1/1951 | Nordin | 49/44 |
| 3,762,098 | 10/1973 | Sheckells | 49/44 |
| 3,782,035 | 1/1974 | Lowe | 49/44 |
| 3,793,773 | 2/1974 | Shelkells | 49/44 |

FOREIGN PATENT DOCUMENTS

| | | |
|---|---|---|
| 381288 | 10/1932 | United Kingdom . |
| 1404976 | 9/1975 | United Kingdom . |

*Primary Examiner*—Kenneth Downey

*Attorney, Agent, or Firm*—Jones & Askew

[57] ABSTRACT

A revolving door has a plurality of leaves mounted for rotation about a common axis. To permit collapse of the door in an emergency, the leaves are mounted, at each end, by means of mechanisms that permit such collapse. There is provided a mechanism for mounting one end of a door leaf, the mechanism having a support plate for rotation about the central axis. First and second pivot means are mounted on the support plate, and corresponding first and second pivot devices are mounted on the door leaf. The pivot means and devices, e.g. corresponding projections and recesses, are such that, the door leaf can pivot about one pair of pivot device and means, while the other pair of pivot device and means separate from one another. Once rotation has commenced about one pair of pivot device and means, they are such that they cannot then be separated, thus securing the door. Biasing means acts on the door leaf to normally maintain the first and second pivot devices in engagement, and thus to maintain the leaf in a normal extended position. A latch mechanism is also provided, for use in the biasing means, which automatically locks a latch member when the door leaf is in its normal position. The latch mechanism can be used with a variety of pivot arrangements.

36 Claims, 15 Drawing Figures

REVOLVING DOOR

TECHNICAL FIELD

This invention relates to a revolving door and, more particularly, this invention relates to a revolving door, in which leaves of the door are adapted to fold or collapse under abnormal pressure. Revolving doors of this type are often referred to as collapsible revolving doors.

BACKGROUND OF THE INVENTION

Collapsible revolving doors are provided, in order to provide a clear passage from a building in an emergency situation. In an emergency, a rigid non-collapsing revolving door can easily become blocked or jammed by the pressure of people hurrying to get through it. In such a situation, a collapsible revolving door will collapse, providing a clear, unobstructed passage, which enables a far greater volume of people to pass through it.

Many different types of mechanism have been proposed to enable revolving doors to collapse. Many of these mechanisms are complex, and suffer from numerous disadvantages. For example, some mechanisms are costly while other mechanisms are difficult and time consuming to install. In many mechanisms the revolving door is not very rigid and it is difficult to adjust the force at which the individual leaves will collapse.

U.S. Pat. No. 2,043,780 (Simpson) is an old disclosure of a collapsible revolving door mechanism, and is nearly 50 years old. Each door wing or leaf is attached to top and bottom discs. For attachment to each disk, three pins are secured to each door leaf. A first pin is disposed adjacent the radially inner edge of the door, and is disposed in a generally V-shaped slot that faces upwards. In the normal position, this first pin is at the bottom of the V-shaped notch or recess. Two further pins, larger than the first pin, are located radially outwards relative to the first pin, on either side of the door leaf. They both engage an arcuate slot centered on the first pin. The slot has a width slightly less than the main body of the further pins, and these two pins have flattened faces adapted to engage this slot. At either end of the slot, there is an enlarged bore corresponding to the size of each of these two other pins. A spring loaded latch-type mechanism retains each door leaf in its usual position. When subject to excessive force, this latch mechanism is overcome, and the particular door leaf can collapse relative to the other leaves. Upon collapse, the leaf first pivots about the first inner pin. It pivots about this pin, until one of the second, larger pins reaches the end of the arcuate slot. At this point, the other of the second larger pins is free to exit the arcuate slot. Consequently, the leaf continues to pivot, but the pivot action now occurs about the pin that has reached its respective enlarged ball at the end of the slot. The second large pin leaves the slot, and the first pin also leaves its V-shaped notch or recess. After a certain amount of movement, the pin in the bore will become fully engaged with the bore, as its flattened face is turned away from the slot, so that it securely retains the leaf.

While this type of mechanism has some advantages over other mechanisms, it is relatively complex and costly. It relies on six separate pins for each leaf, resulting in a total of 24 pins for a four leaf door. Also, assembly and disassembly of this sort of mechanism is quite difficult, and frequently special means have to be provided for this. A number of other patents disclose this type of mechanism and to distinguish it from other collapse mechanisms, it will be described as a "3-pin mechanism".

U.S. Pat. No. 2,539,790 (Nordin) is another disclosure of a "3-pin mechanism". The arrangement here is somewhat different in that the pins are fixed in position, and each door is provided with a span arm, including notches adapted to engage these pins. Additionally, each span arm has a pin located in a cam track, to control the motion of the door leaf. Again, in a normal position, each span arm is retained by a spring biased latch mechanism against a first pin. In response to abnormally large forces, each door leaf can collapse. For collapse in one direction, the leaf pivots about the first pin until a notch engages another pin. At this point, the pin attached to the door has reached the beginning of a circular section of the cam track centered on the second pin. Consequently, the leaf can continue to rotate or collapse about the second pin. Here again, the overall construction is complex and requires numerous different components. Assembly and disassembly would be quite complex.

U.S. Pat. Nos. 3,762,098 and 3,793,773 (both in the name Sheckells) both disclose similar revolving door mechanisms, including a 3-pin collapse pin mechanism. Each door or door leaf is mounted via a small pin and two larger pins. Each of the larger pins is generally cylindrical, with one face formed as part of a circle centered on the small pin. In the normal position,these faces of the larger pins are against a corresponding curved surface of a hanger disk. A latch-type detente mechanism retains the door in its usual position. In response to excessive force, the door first starts to pivot about the small pin. This motion continues until one of the larger pins enters a respective, corresponding cylindrical recess. At this stage, the door then pivots about this larger pin. The second larger pin is then free, as is the small pin. Consequently, the door can rotate unobstructed about the larger pin. Here, again, the arrangement of larger pins with bearing surfaces and corresponding cylindrical recesses is such that after rotation commences around one of the larger pins, that larger pin is retained in its cylindrical recess and cannot leave it until the door is returned to its normal position. This construction, like many of the other known constructions, is somewhat complex. The arrangement for attachment and removal of the individual doors or door leaves is complex. Either special screws or removable portions are needed to enable fitting and removal of the door leaves.

Applicant's earlier U.S. Pat. No. 3,782,035 is of some interest, in that it discloses a door mechanism effectively provided with two separate pivot locations for each door. One pivot location being for collapse in one direction and the other pivot location being for collapse in the other direction. At each end, each door leaf is provided with two seats for receiving spring loaded balls. The engagement of a pair of spring loaded balls at either end of the door leaf locates it in position. In response to excessive force, one ball seat at the top and one at the bottom become disengaged from their respective balls, to permit rotation of the door about the remaining two engaged balls and ball seats. While this provides a collapsible door structure, it suffers from some disadvantages. The doors are retained in position solely by the pressure of the balls on the ball seats. Thus, to secure the doors, the springs acting on the balls have to provide considerable pressure. This pressure or force has to be transmitted through the central shaft of the door from top to bottom, and consequently, this shaft is under considerable stress. Assembly and disassembly is complicated and requires tensioning the shaft to apply the pressure to the balls. Also, a single door leaf cannot readily be removed. Since the doors are only located by means of balls acting in ball seats, a rigid structure is only obtained with larger forces.

For a revolving door, including a collapse mechanism, it is desirable that the structure should be as simple as possible. The arrangement should be such as to permit the door to be readily assembled and disassembled. Also, it should permit any one individual door or door leaf to be quickly and easily removed or installed, without affecting the remainder of the doors. Also, the door structure should be such as, in normal use, to provide a rigid, stable structure. Many known mechanisms rely upon some type of spring loaded detent mechanism, in which a latch is displaced sideways from a seat. The latch has to be arranged to be displaced sideways, to accommodate movement in two different directions, for the two possible collapse modes. Such an arrangement inherently leads to a structure which is not that rigid, as the latch is either a ball or tapered wedge resting in corresponding seat. It is desirable that the latch mechanism provide a more positive engagement of each door leaf in its usual position.

SUMMARY OF THE INVENTION

According to the present invention, there is provided for a collapsible revolving door including a plurality of door leaves which normally rotate together about a central axis, a mechanism for mounting one end of a door leaf, the mechanism normally retaining the door leaf in an extended position and permitting folding of the door leaf, and the mechanism comprising: a support plate for rotation about said central axis of a revolving door, which support plate includes first and second spaced pivot means; first and second pivot devices mountable on a door leaf for engaging the first and second spaced pivot means respectively, the arrangement being such that, in use, either one of the first and second pivot devices can become disengaged from its respective pivot means to enable the door leaf to rotate about a pivot axis of the other one of said first and second pivot means, whereupon after commencement of such rotation, the other one of the first and second pivot devices cannot disengage from its respective pivot means; and biasing means for normally maintaining the first and second pivot devices in engagement with the first and second pivot means, to retain the door leaf in a normal extended position.

The mechanism can have a number of advantages over conventional mechanisms.

The pivot devices and means are such as to permit disengagement when in the normal position. But, if rotation commences about one pair of pivot device and means, then, after commencement of rotation, they can no longer become disengaged from one another. This arrangement need not rely upon strong spring forces and a ball and seat type arrangement as incorporated in applicant's earlier U.S. Pat. No. 3,782,035. Instead, the pivot means can comprise an arcuate projection, centered on the other pivot means. Ends of the arcuate projection should form parts of a circle centered on that pivot means. Correspondingly, the respective pivot device includes an arcuate slot centered on the other pivot device, and a circular or cylindrical recess centered on its own axis. The arcuate projection and slot permit disengagement, when rotation commences about the other pair of pivot device and means. On the other hand, if rotation occurs about this pair of pivot device and means, then, after commencement of rotation, the arcuate projection is no longer aligned with the arcuate slot, to prevent disengagement. Rotation then occurs between the cylindrical recess and the correspondingly shaped end surfaces of the arcuate projection.

Such a configuration requires no actual loads to be applied to the door leaf, so that a central shaft of the door mechanism does not have to carry any great loads. This greatly facilitates installation and removal of any one door leaf, and this can be accomplished without disturbing the rest of the leaves in any way.

The mechanism also enables the latch means to be entirely separate from the pivot arrangement, in contrast to the technique used in applicant's earlier U.S. Pat. No. 3,782,035 and other prior revolving door mechanisms. This provides great freedom in the choice of mechanism for the latch mechanism.

Preferably, the latch mechanism is located in the plane of the door leaf, with the first and second pivot devices being located symmetrically on either side. Then, for rotation in either direction, the latch mechanism attached to the door leaf will, at least initially, move radially outwards. Thus, in contrast to most known designs, the latch mechanism moves in the same direction for both folding or collapse directions. Advantageously, this feature is used by providing a latch mechanism in which this motion acts directly on a latch, and is not transmitted indirectly by a wedge type action that converts sideways motion to motion of the latch. Thus, the latch should be mounted for movement radially in the plane of the door. Rotation of the door about either pivot axis can thus cause direct movement of the latch against the biasing action of the appropriate spring means. It has been found that this type of biasing mechanism can provide a door structure that, in normal use, is rigid and does not feel resilient. This can be achieved, while providing for collapse under an appropriate excess load on the door leaf.

As another aspect of the present invention, there is provided a latch mechanism for use in mounting leaves of a revolving door, the latch mechanism comprising: a stop member, for mounting on the support plate or the like of a revolving door; a latch member and associated biasing device, for mounting on a door leaf, the latch member being mounted for abutment against the stop member so that, for all pivotal movement it is displaced in the same direction, and the biasing device acting on the latch member to resist deflection of the latch member as a result of pivotal movement of a door leaf.

The latch mechanism can include a catch member for engaging and retaining the latch member in a displaced position, after the latch member has moved beyond a preset position. Further the catch member can be such that it automatically releases the latch member when the door leaf is swung back into its normal position. This can be achieved by providing a spring biased catch member that engages a minor latch projection of the latch member, and which contacts a central shaft of the door, when the leaf is swung into its normal position, to release the latch mechanism.

The latch member is conveniently pivotally mounted between the two pivot axes of a door leaf, with its axis extending perpendicular to the door plane. Then, one end of the latch member can be acted upon by a bias spring, while the other end engages the stop member.

It is expected that the latch mechanism could be used in mounting mechanisms other than that disclosed here. Unlike known mechanisms which rely on side ways displacement of a projection from a notch or the like, here the latch member is displaced in the same direction as the biasing force to provide a positive rigid engagement.

BRIEF DESCRIPTION OF THE DRAWINGS

For a better understanding of the present invention, and to show more clearly how it may be carried into effect, reference will now be made by way of example, to the accompanying drawings, which show a preferred embodiment of the present invention, and in which.

DETAILED DESCRIPTION

Figure 1:
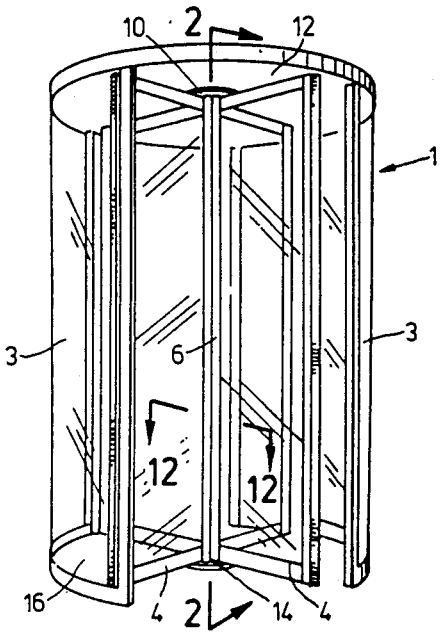
FIG. 1 is a perspective view of a revolving door according to the present invention.

Referring first to FIG. 1, there is shown a revolving door generally denoted by the reference 1. The revolving door 1 rotates within an outer shell 3, formed in known manner by two part-cylinder panels. In the embodiments shown, the revolving door 1 includes four separate door leaves 4 mounted to rotate with a central vertical shaft 6. The vertical shaft 6 is normally hidden from view. The door leaves 4 are mounted at the top to an upper collapse mechanism 10, at least partially recessed in a ceiling 12. At the bottom, the leaves 4 are mounted to a bottom collapse mechanism 14 located also at least partially recessed in a floor 16. The central shaft 6 is also connected to the upper and lower collapse mechanisms 10, 14, to ensure that they rotate with one another. The collapse mechanisms, 10, 14 maintain the leaves 4 in normal extended position so they rotate together as a unit, together with the shaft 6. The mechanisms 10, 14 also permit and control individual collapse of the leaves 4.

Figure 2:
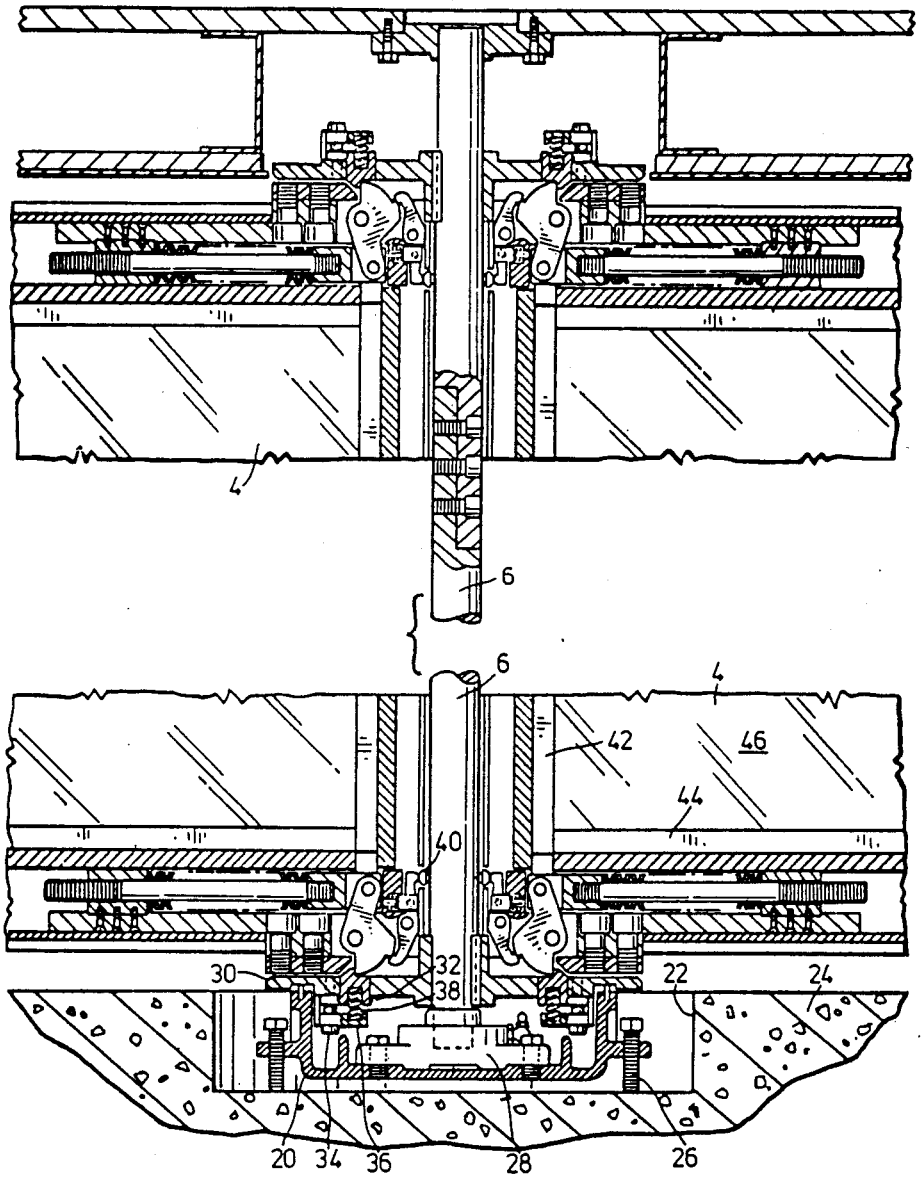
FIG. 2 is a vertical cross-section through the door of FIG. 1 along the line 2—2 with a central section omitted.

The collapse mechanisms 10, 14 include individual mechanisms for each door leaf, and these are generally identical, although slightly different mechanisms could be provided for each door leaf and a different mechanism could be provided at the top, as compared to the mechanism at the bottom. The following description is made with reference to a mechanism of the bottom collapse mechanism for one door leaf, but it is understood that it applies equally to the upper collapse mechanism 10. In FIG. 2, components of the upper collapse mechanism 10 corresponding to the lower collapse mechanism 14 are given the primed reference numerals corresponding to the reference numerals for the lower collapse mechanism 14.

Turning now to FIG. 2, there is shown in detail a vertical section through the upper and lower collapse mechanisms 10, 14, with a central portion of the shaft 6 omitted for clarity. The lower collapse mechanism 14 includes a generally bowl-shaped housing 20. The housing 20 is located in a recess 22 of a concrete or other floor 24. The housing 20 is provided with at least three screws or bolts 26, for adjusting its position relative to the floor 24. If desired, the screws 26 can bear on a suitable bearing plate. Inside the housing 20, and bolted to it, is a bearing 28. The bearing 28 is provided for the central shaft 6, and supports the shaft 6 together with the door leaves 4. Mounted on the lower end of the shaft 6 is a plate or disk 30.

At four equally spaced locations around the shaft 6, the plate 30 includes apertures for stop members 32. Each stop member 32 is slidably mounted for vertical movement in its aperture in the plate 30. Extending below the plate 30, for each member 32 are two pins or bolts 34, to the lower end of which a bracket 36 is secured. The respective stop member 32 has two holes through which the pins 34 pass to guide the motion of the stop member 32. A coil spring 38 is provided between the bracket 36 and the stop member 32, to urge the stop member 32 upwards to the positions shown for the two stop members at the bottom of FIG. 2.

The shaft 6 is additionally provided with operating projections 40 for latch mechanisms of the door leaves 4 and the purpose of these projections 40 is described in greater detail below.

In known manner, each of the door leaves 4 includes a frame formed from vertical frame elements 42 and horizontal frame elements 44 of extruded aluminum. Within the frame formed by the element 42, 44, there is a sheet of glass 46.

Figure 3:
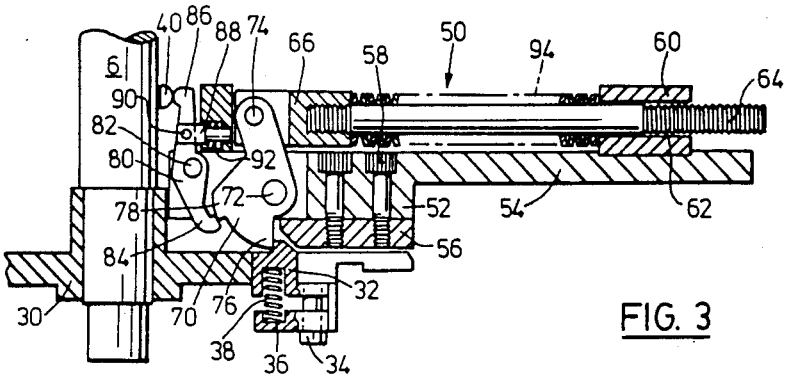
Figure 8:
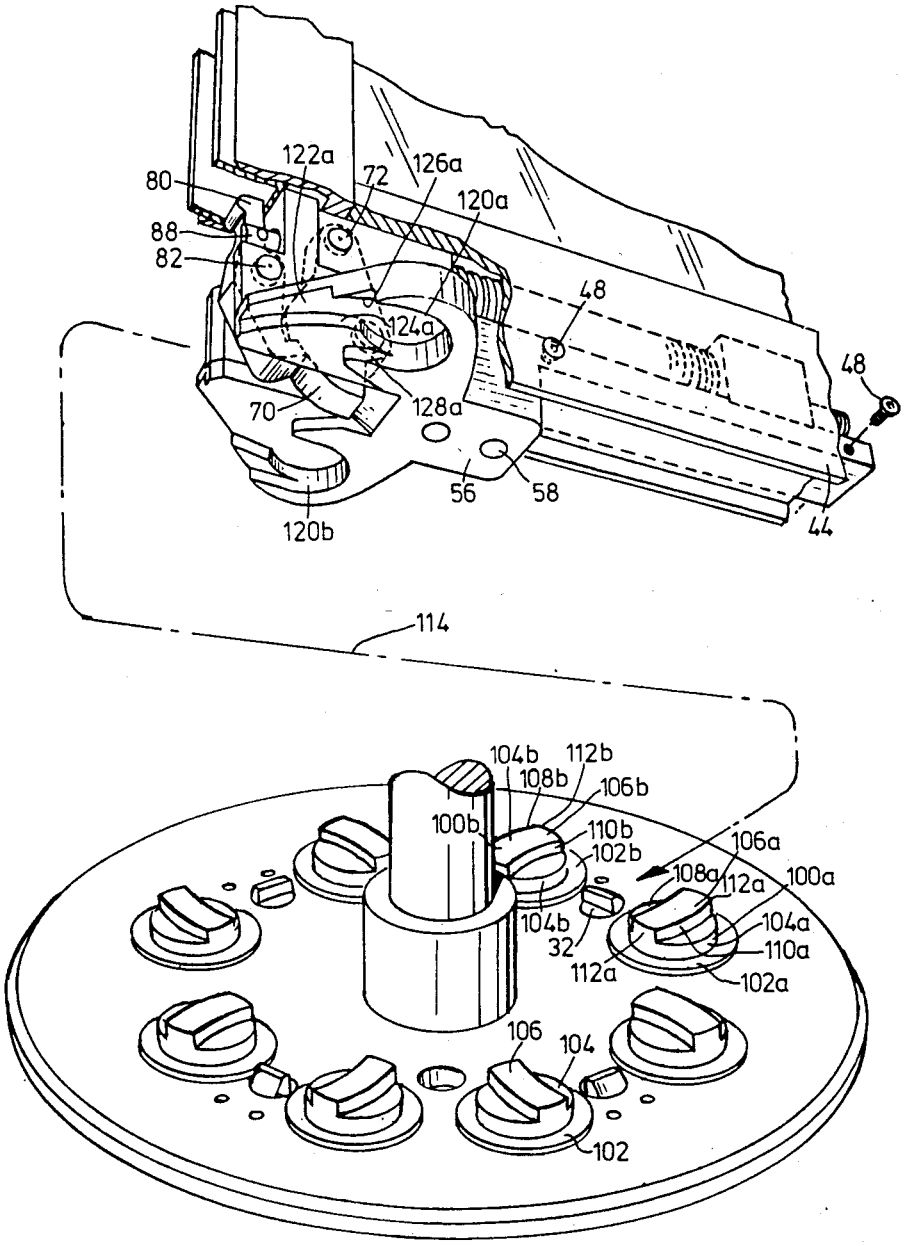
FIG. 8 shows a perspective view from above of a bottom support plate and a perspective view from underneath of a latch mechanism.

At the bottom of each door 4, there is a latch mechanism generally indicated in FIG. 3 by the reference 50. The inner end of the bottom horizontal frame element 44 is formed with an inverted U-shape. Preferably, the frame element 44 has a generally box cross-section and a bottom web of the box is machined away to form the inverted U-shape. This enables a respective latch mechanism 50 to be located between sides of the lower frame element 44. The mechanism 50 is secured by screws 48 passing through openings in the frame element 44 as shown in FIG. 8.

FIG. 3, and following figures, shows one of the latch mechanisms 50 in greater detail. Each latch mechanism 50 comprises a main body 52 formed from an elongate arm 54 and a base member 56. The arm 54 and base member 56 are secured together by bolts 58. At a radially outer end of the arm 54, there is a member 60. The member 60 is also bolted (the bolts not being shown) to the arm 54. The member 60 has a smooth bore 62, through which extends a threaded shaft 64. The other, radially inner, end of the threaded shaft 64 is screwed into a blind bore of a bracket member 66.

A radially inner end of the arm 54 has two side arms with a slot in between. Within this slot, there is a latch member 70, which is pivotally mounted by a horizontal shaft 72 to both side arms of the elongate arm 54. At its upper end, the latch member 70 is attached by another pivot shaft 74 to the bracket member 66. Again, the bracket member 66 has two side arms, between which the latch member 70 is located with the pivot shaft 74 mounted in both side arms.

The latch member 70 has a major latch projection 76. Additionally, for purposes described below, it includes a minor latch projection 78. A catch 80 is pivotally mounted on a further pivot shaft 82 extending between the side arms of the elongate arm 54. The catch 80 includes a catch projection 84 and an actuating projection 86 at an opposite end. Above the pivot shaft 82, a small plunger 88 includes a small yoke engaging the catch 80 and pivotally connected to it by a small pivot shaft 90. A spring 92 is provided around the plunger 88 between its yoke and the arm 54. This spring 92 urges the plunger 88 to the left, and consequently urges the catch 80 counter-clockwise.

Around the shaft 64, there is an elongate spring 94 urging the bracket member 66 and shaft 64 to the left. Consequently, this spring 94 serves to urge the latch 70 counter-clockwise as well. The spring 94 is preferably made up from a plurality of disk springs as shown, with the disk springs alternately facing in opposite directions. However, a coil spring, or other spring arrangement could be provided.

FIG. 3 shows the latch mechanism 50 in a normal or usual position. Here, the latch 70 is free from the catch 80. Consequently, the spring 94 is free to urge the latch counter-clockwise. Its latch projection 76 is then urged against the stop member 32, thereby urging the respective door radially inwards.

As shown most clearly in FIG. 8, for the lower collapse mechanisms 14, on the plate 30, there are additionally mounted eight pivot projections 100. Each pivot projection 100 is a separate element, located in a corresponding bore (not shown) in the plate 30. It preferably includes a threaded shaft to enable it to be secured from below by a nut. Also, it includes means for ensuring that it is at the correct angular orientation.

Each of the pivot projections 100 includes a base disk 102, a cylindrical portion 104, and a arcuate projection 106. Ends of the arcuate projection 106 are continuations of the cylindrical portion 104. Side surfaces of the arcuate projections 106 are parts of a circle centered on a corresponding pivot projection 100. Thus, at the right back side of the plate 30 as viewed in FIG. 8, one stop member 32 is marked. On either side of this stop member are two pivot projections 100 which to identify them are given separate references 100*a* and 100*b*. The pivot projection 100*a* has an arcuate portion 106*a*, whose side surfaces are centered on the axis of the pivot projection 100*b*. Similarly, the pivot projection 100*b* has an arcuate portion 106*b*, whose side surfaces are centered on the axis of the pivot projection 100*a*. The reason for this arrangement will become clear when the operation of the mechanism is described below.

The surfaces of the arcuate portions 106*a* and 106*b* are individually marked. Thus, for the pivot projection 100*a*, the arcuate portion 106*a* has radially inner and outer arcuate surfaces 108*a* and 110*a* respectively; the designation "radially inner" and "radially outer" being with reference to its pivot axis at the other pivot projection 100*b*. The ends of the arcuate portion 106*a* comprise cylindrical surfaces 112*a*, which are extensions of the cylindrical portion 104*a*. The arcuate portion 106*b* of the other pivot projection 100*b* similarly comprises radially inner and outer arcuate surfaces 108*b* and 110*b*, together with cylindrical end surfaces 112*b*.

Corresponding to the pivot projections 100, the base member 56 of each latch mechanism 50 is shaped to engage two pivot projections 100. In FIG. 8, there is shown a base member 56 intended to engage the pivot projections 100*a* and 100*b*, as indicated by the arrow 114. Corresponding to the designations 100*a* and 100*b* for the two pivot projections, the suffixes a and b are used for like parts of the latch mechanism 50 shown in FIG. 8.

The base member 56 includes two recesses 120*a* and 120*b*, for the two projections 100*a*, b. The recess 120*a* is generally cylindrical, corresponding to the cylindrical portion 104*a*. Extending from the recess 120*a* is an arcuate slot 122*a*. It has radially inner and outer curved surfaces 124*a* and 126*a* respectively, which are centered on the other recess 120*b*. The arcuate slot 122*a* has the same width and corresponding profile as the arcuate portion 106*a*. The recess 120*a* also includes, adjacent a bottom surface of the base member 56, a portion 128*a*, which defines a short arcuate section. This short arcuate section 128*a* has a width equal to the diameter of the cylindrical portion 104*a*, and again is centered on the other recess 120*b*. The arcuate slot 122*a* and the short arcuate section 128*a* permit the pivot projection 100*a* to disengage or leave the recess 120*a*, when rotation occurs about the other pivot projection 120*b*, as described in greater detail below. The other recess 120*b* generally corresponds to the recess 120*a*, and like reference numerals are assigned to it.

There are various aspects to the behavior of the whole revolving door 1. There is the motion of each individual door leaf 4, when it collapses, and also the various modes of operation of each latch mechanism. Additionally, there is the overall motion described by the door leaves, as the revolving door collapses. These three different aspects of the invention will be discussed separately, for greater clarity. They are discussed in this order below.

Figure 9:
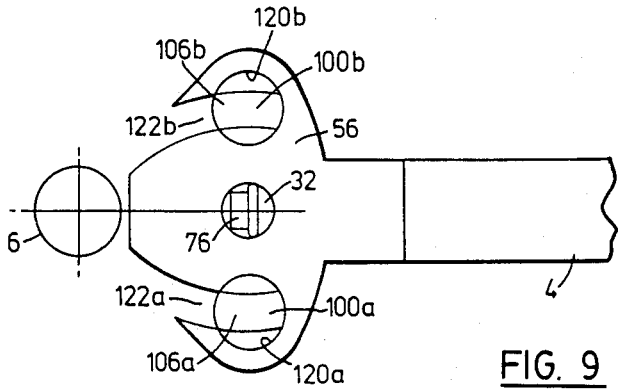
FIGS. 9, 10 and 11 show diagramatically a plan view of part of one door leaf, showing different positions.
Figure 10:
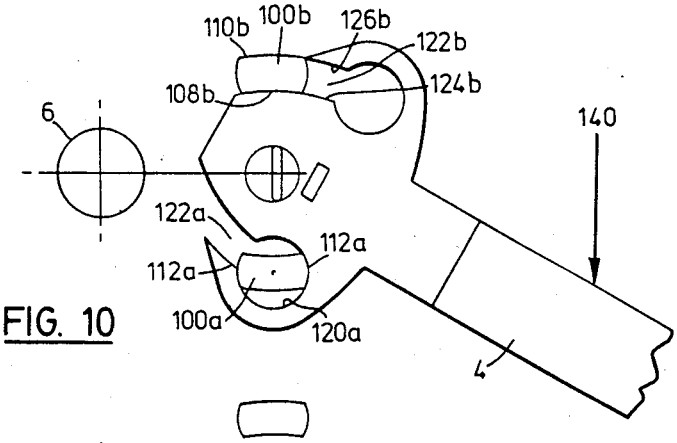
Figure 11:
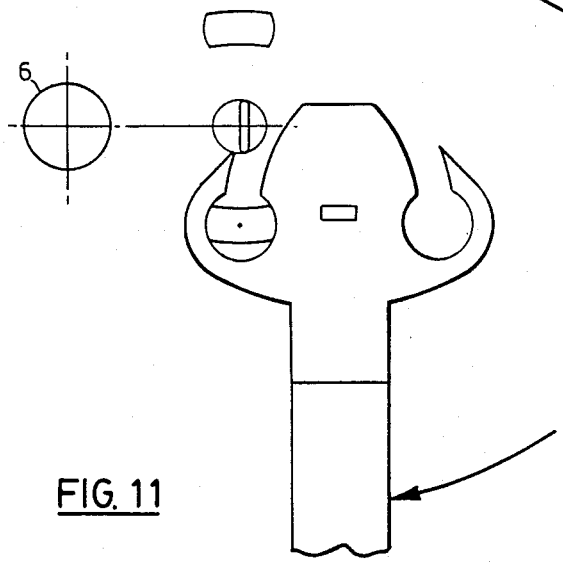

Reference will first be made to FIG. 9, 10 and 11, which show diagramatically part of one door or leaf. Here, for greater clarity, only components essential to the motion of an individual door leaf are shown.

Thus, in FIG. 9, there is seen a base member 56 of a latch mechanism engaged with pivot projections 100*a*, *b*. Thus, a door leaf 4, associated with this base member 56 is in a normal extended position, relative to the central shaft 6. The leaf 4 and shaft 6 are shown in outline only. The major latch projection 76 of the latch member 70 engages the stop member 32, and provides a spring biasing force maintaining the door leaf 4 in the normal, extended position shown. As clearly shown, in this position the pivot projections 100*a*, *b* are fully located in the recesses 120*a*, *b*.

In use, if an excessive force is applied to the door leaf 4 shown in these FIGS. 9, 10 and 11, then the biasing force of the latch mechanism 50 can be overcome. When this occurs, the latch 70 becomes disengaged from the stop member 32, and this aspect of the mechanism is described in greater detail below. FIG. 10 shows what happens when an excessive clockwise force, indicated by the arrow 140 is applied to the door leaf 4. After disengagement of the major latch projection 76 from the stop member 32, the door 4 rotates clockwise, under the influence of the force. This rotation is achieved by rotational movement about the axis common to the pivot projection 100*a* and the recess 120*a*. As this pivotal movement occurs, the other side of the base member 56 disengages from the pivot projection 100*b*. Thus the pivot projection 100*b* slides along the arcuate slot 122*b*, as shown in FIG. 10. It is to permit this sliding movement that the arcuate surfaces 110*b*, 112*b* and the side surfaces 124 band 126*b* of the slot 122*b* are centered on the axis of the pivot projection 100*a*. Also, the cylindrical portion 104b slides along its corresponding arcuate slot 128*b* (not visible in FIGS. 9–11).

Simultaneously with the disengagement of the pivot projection 100*b* from the recess 120*b*, the pivot projection 100*a* becomes firmly engaged with the recess 120*a*, to retain the leaf 4. Either of the pivot projections can only be disengaged from their respective recesses, if they are perfectly aligned with the respective slots. Thus, after rotation has commenced about the pivot projection 100*a*, its cylindrical end surfaces 112*a* engage the recess 120*a* so as to prevent disengagement of the projection 100*a*. In particular, as viewed in FIG. 10, the left-hand surface 112*a* comes into contact with the side walls of the recess 120*a*, and no longer faces the slot 120*a* directly, thereby preventing disengagement from the recess 120*a*.

FIGS. 9, 10 and 11 show the motion at one end of the door 4. It will be understood that this motion is exactly duplicated at the other end of the door. Thus, once the position shown in FIG. 10 is reached, the latch mechanisms no longer exert any force on the door leaf. The door leaf is now free to rotate about an axis entending through the pivot projection 100*a* and through a pivot projection at the upper end of the door. Because of the engagement of the member 56 with the projection 100*a*, the door leaf 4 cannot become completely loose. As no spring biasing force is exerted on the door 4, it can now freely rotate, until, for example, it reaches the position shown in FIG. 11. In the event of an emergency, the door is then free to swing to adopt any position that leaves the doorway unobstructed. The extent of the doors movement is only limited by the other doors, as discussed below.

Reference will now be made to FIGS. 3–7, which show the behavior of the latch mechanism 50.

FIG. 3 shows the mechanism 50 in a normal, extended position, corresponding to FIG. 9. In this position, the major latch projection 76 of the latch member 70 engages the stop member 32. The main spring 94 acts, indirectly, on the latch member 70, to retain the respective door leaf in its normal position.

In response to abnormal or excessive forces applied to the door, the door 4 will rotate about a pair of pivot projections on one side, as shown in FIGS. 9–11, against the action of the latch mechanism 50. As the door commences to rotate, the latch 70, as viewed in FIG. 3 is rotated clockwise, against the compressive action of the spring 94. This rotation of the latch 70 continues, as the door is rotated, until the latch projection 76 is raised sufficiently to clear the stop member 32. In this respect, it is to be noted that the contacting faces of the latch projection 76 and stop member 32 are such that no great downward force is applied to the stop member 32, during this action. Consequently, the stop member 32 is not urged downwards against the action of its spring 38, which is considerably less stiff than the spring 94. The force from the latch projection 76 on the stop member 32 is transmitted to the disk 30.

Figure 4:
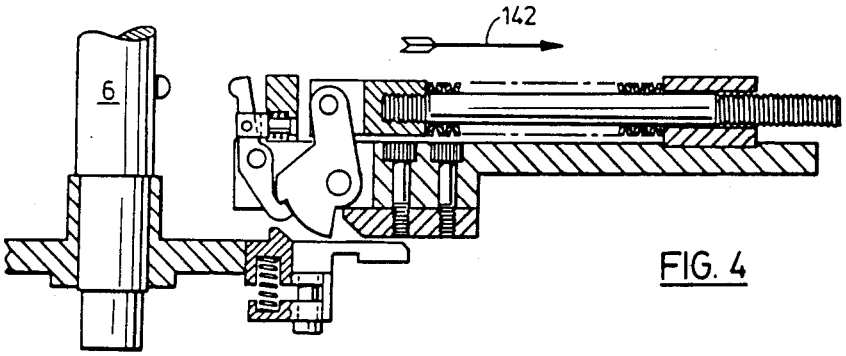

When the latch member 70 has rotated sufficiently for the latch projection 76 to clear the stop member 32, the minor latch projection 78 has cleared the catch projection 84. After the latch member 70 clears the stop member 32 (as shown in FIG. 4), the spring 94 will snap the latch 70 back, until the minor latch projection 78 contacts the catch projection 84. This is shown in FIG. 4.

Then, as indicated by the arrow 142, the door, including the mechanism 50 is free to rotate, causing the mechanism 50 to, at least initially, move radially outwards, relative to the shaft 6.

Note that, as shown in FIG. 2, each door includes two latch mechanisms 50 so that both mechanisms have to become disengaged, before the door is free to rotate. As shown in FIG. 2, the mechanisms can be similar, so that they will effectively become disengaged simultaneously. If desired, one could simply provide a latch mechanism at one end of the door. Preferably, the latch mechanism is provided at the top of the door, as the natural weight of the door will tend to keep the bottom of the door properly engaged with its pivot projections.

As described above, when the latch mechanism 50 becomes disengaged from its stop member 32, the latch 70 is retained in by the catch 80. This configuration, is a "cocked position", in which the latch member 70 is held ready for re-engagement with the stop member 32. It is not necessary for this cocked position to be used, after disengagement of the latch 70. Alternatively, the latch member 70 can be simply allowed to spring back, under the action of the spring 94, after leaving the stop member 32.

As is described below, the mechanism 50 can only be re-engaged when in the cocked position shown in FIG. 4. Thus, it is necessary to provide some means for cocking the mechanism, particularly where the mechanism is such that disengagement does not automatically place the latch 70 in the cocked position of FIG. 4.

Figure 5:
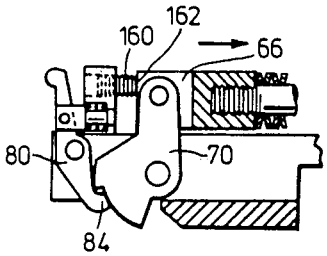

FIG. 5 shows details of the cocking mechanism. The cocking mechanism simply comprises a screw 160, which is located behind the catch 80, and is not shown in other figures. The screw is provided with a socket at its left-hand end, for receiving an Allan key or the like. To cock the mechanism 50, the screw 160 is simply screwed clockwise, so that its end 162 comes up against the bracket member 66 and urges it to the right against the action of the spring 94. This motion also rotates the latch member 70 into the cocked position. As shown in FIG. 5, the latch member 70 is rotated, until its minor projection 78*b* has cleared the catch projection 84. The screw 160 is then unscrewed, to provide clearance for anti-clockwise rotation of the latch member 70 and the corresponding movement of the bracket number 66. As the screw 160 is unscrewed, the catch 70 comes into the cocked position of FIG. 4 and is held in this position.

Figure 6:
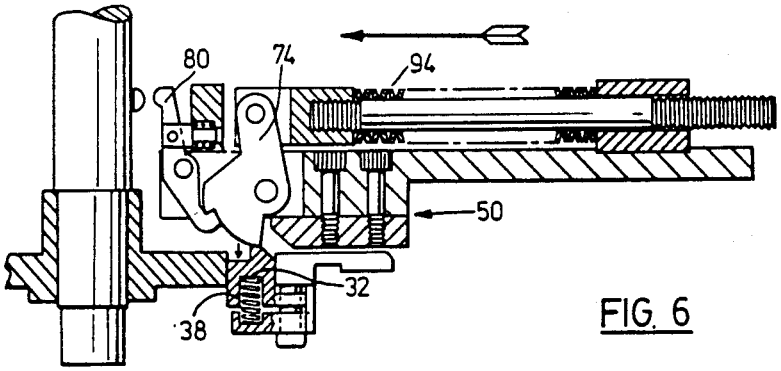
FIG. 3-7 show a vertical cross-section through parts of a central shaft and a latch mechanism, in different positions.
Figure 7:
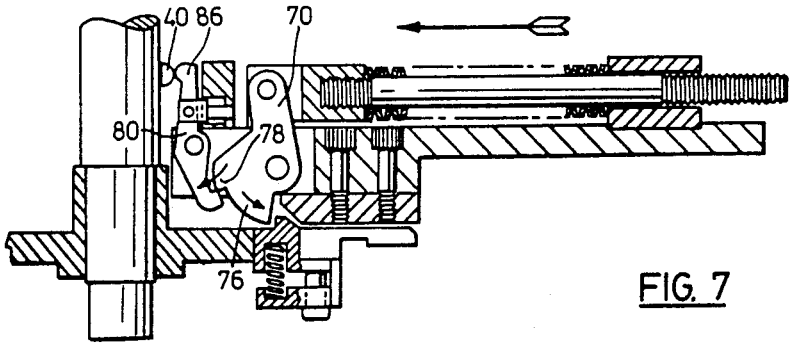

To fit a mechanism 50 into position, one of the recesses 120*a, b* is engaged with a respective pivot projection 100*a, b*. This is achieved by placing the mechanism 50 on the appropriate pivot projection, with the mechanism being clear of the other pivot projection and the respective stop member 32. The mechanism 50 is then rotated, in reverse to the motion described with reference to FIGS. 9, 10 and 11. Consequently, the other recess then comes into engagement with its pivot projection. This motion is shown in FIGS. 6 and 7. FIG. 6 shows the latch member 70 passing over the stop member 32. During this motion, the stop mmber 32 is depressed downwards against the action of the spring 38, to permit the latch member 70 to pass over it. As the latch member 70 is held in the cocked position by the catch 80, its major projection 76 will clear the stop member 32. When the mechanism 50 becomes fully engaged with its two pivot projections, it is automatically uncocked. This is shown in FIG. 7. As the mechanism 50 reaches its normal position, the actuating projection 86 of the catch 80 contacts the operating projection 40. This urges the catch 80 clockwise, as indicated by the arrows in FIG. 7, against the action of the spring 92. As a result, the catch projection 84 releases the latch 70, which is then urged against the stop member 32, by the main spring 94.

The mechanism 50 has then been returned to its normal position.

To locate one door into position, the bottom latch mechanism 50 is fully positioned as described above. Then the top latch mechanism 50 is similarly positioned and fully engaged with its two pivot projections. The top mechanism 50 will then have to be held in place. A door 4 is then slid radially inwards, to engage both these two latch mechanisms 50. Once in position, the door 4 is secured to the mechanism by screws 48 (FIG. 8). The door 4 is then secured in position and can only be displaced, either by reversing the assembly procedure or by swinging it about one pivot access against the biasing action of the two latch mechanisms.

An alternative assembly technique is to first position the two latch mechanisms for one door on one pivot projection each. The door leaf itself is then slid into position and secured by the screws 48. The door can then be pivoted into its normal position, and as it reaches its normal position both the latch mechanisms will become uncocked, to then retain it in that position.

Thus, to assemble a complete revolving door 1, the central shaft 6, and associated upper and lower bearings are first assembled in position. Then, each leaf and its associated latch mechanisms 50 can be assembled into their usual extended position. The individual leaves can be assembled or positioned individually, one after the other. The stability or integrity of the door does not rely upon the presence of any particular leaf. Thus, the door can be assembled in any manner that is convenient. This is to be contrasted with many known revolving door constructions, in which there are various interconnections between the different elements of the door, which make assembly and disassembly difficult and time consuming.

Reference will now be made to Figures 12–15, which show the behavior of the whole revolving door 1, as the individual door leaves collapse. To distinguish the individual door leaves in these figures, they are given the references 4*a*, 4*b*, 4*c* and 4*d*.

Figure 12:
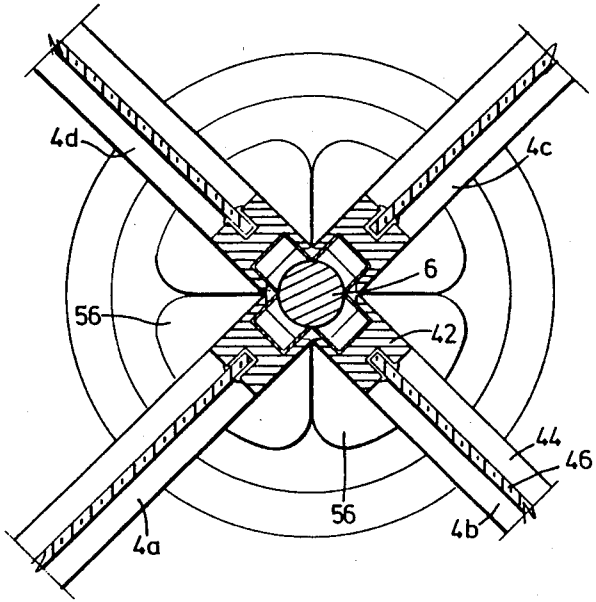
Figure 15:
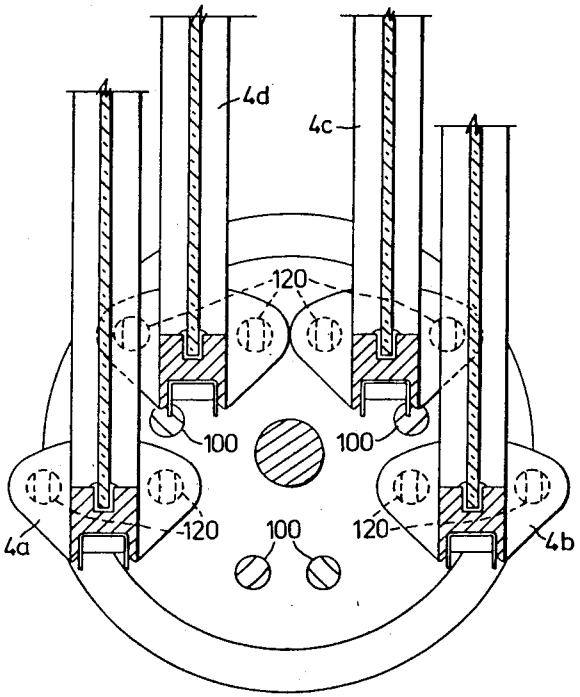

Referring first to FIG. 12, there is shown a revolving door 1 with the door leaves 4 in their normal extended position. The door leaves 4 are at right angles to one another in this position. Also, in this configuration, the four base members have faces that abut or are close to one another. In normal use, the door leaves 4 will maintain this orientation. The main springs 94 of the mechanisms 50 are so adjusted that normal forces applied to the door leaves, to rotate the whole revolving door 1, will not cause collapse of any door leaf.

Figure 13:
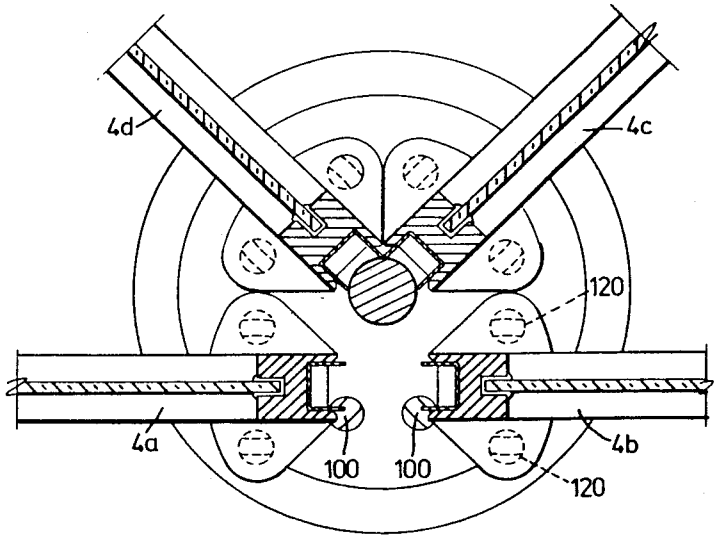
FIGS. 12-15 show a plan view of inner ends of the four door leaves of the revolving door, showing different positions as the doors are folded, along line 12—12 of FIG. 1.

If an abnormally high load is applied to the leaves 4, then they can collapse. In particular, it is intended that the leaves should collapse when in an emergency, such as a fire, a large crush of people attempt to pass through the revolving door 1. As shown in FIG. 13, if large forces are applied to leaves 4*a*, *b*, then these two leaves will pivot away from one another. Thus, the leaf 4a pivots clockwise, as viewed in FIG. 13, and becomes disengaged from the pivot projection 100 marked. It similarly becomes disengaged from another pivot projection at the top. Correspondingly, the door leaf 4*b* pivots or rotates counter-clockwise, and becomes disengaged from another marked pivot projection 100 and a corresponding top pivot projection (not shown). The door leaves 4*a*, *b* are shown in positions, where their respective latch members 70 have become disengaged. The leaves 4*a*, *b* are then free to pivot or rotate, about the pivot projections which still engage them and securely retain them.

Figure 14:
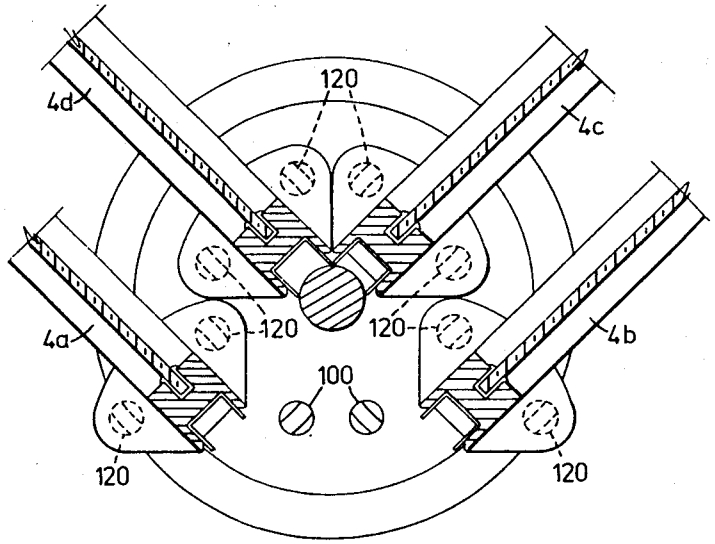

Referring to FIG. 14, rotation of the door leaves 4*a*, *b* will continue under the influence of an applied force, until their free radially, outer ends contact leaves 4*d*, 4*c* rspectively. This position is indicated in FIG. 14.

If any excess or abnormal force is then applied to the leaves 4*a*, 4*b*, it will be transferred to the leaves 4*d*, 4*c*. As a consequence, the leaves 4*c*, *d* will themselves become displaced from their normal extended position. At each end, the door leaves 4*c*, *d* will become disengaged from the pivot projections remote from one another, and they will begin to rotate about the two adjacent pivot projections. Thus, the leaf 4*d* will rotate clockwise, while the leaf 4*c* rotates counter-clockwise. As all the latch mechanisms 50 will then have been released, all the four door leaves 4*a*, *b*, *c* and *d* will be free to rotate, while not being capable of becoming detached from the whole door assembly. Consequently, the leaves will rotate, until they reach the position shown in FIG. 15, in which they are all generally parallel to one another. In this position, two clear passages will be provided on either side of the door leaves, to provide clear, unobstructed passages for quick exit from a building.

As clearly shown in FIGS. 12, 13, 14 and 15, the pivot arrangement for the door leaves 4 has to be such that they can collapse and adopt a mutually parallel configuration. It is for this reason that each door needs two separate pivot axes, spaced apart from another. Also, disengagement of a recess 120 from a pivot projection 100 has to occur by a radially outwards movement.

It is conceivable that the pivot projection and recesses could be arranged for disengagement as a result of a radially inwards movement. However, such an arrangement would only provide for limited movement of the individual door leaves. The action of the latch member 70 or other biasing means would have to be reversed.

Although the present invention has been described in conjunction with preferred embodiments, it is to be understood that modifications and variations may be utilized without departing from the principles and scope of the invention as defined by the following claims.

I claim:

1. A mechanism for mounting at one end of a door leaf of a collapsible revolving door including a plurality of door leaves which normally rotate together about a central axis, the mechanism comprising:

a support plate for rotation about said central axis of a revolving door, which support plate includes first and second spaced pivot means;

first and second pivot devices mountable on a door leaf for engaging simultaneously the first and second spaced pivot means respectfully, said pivot devices being spaced apart by the same amount as said spaced pivot means.

the arrangement being such that, in use, either one of the first and second pivot devices can become disengaged from its respective pivot means to enable the door leaf to rotate about a pivot axis of the other one of said first and second pivot means whereupon after commencement of such rotation, the other of the first and second pivot devices cannot disengage from its respective pivot means; and biasing means for normally maintaining the first and second devices in engagement with the first and second pivot means, to retain the door leaf in a normal extended position.

2. A mechanism as claimed in claim 1, wherein one of the pivot devices and the pivot means comprises projections, and the other of the pivot devices and the pivot means comprises recesses adaptd to engage the projections.

3. A mechanism as claimed in claim 2, wherein each projection and each corresponding recess include respective first parts for rotation of a door leaf about an axis of that pivot projection and that recess, and respective second parts arranged to enable the projection and recess to disengage from one another.

4. A mechanism as claimed in claim 1, wherein each of the first and second pivot means comprises a pivot projection, and each of the first and second pivot devices comprises a corresponding recess.

5. A mechanism as claimed in claim 4, wherein each pivot projection comprises a cylindrical portion and adjacent the cylindrical portion an arcuate portion at a free end of the pivot projection, and wherein each recess correspondingly comprises a blind, shallow cylindrical bore adapted to engage a respective arcuate portion, a first, arcuate slot adapted to slidingly engage a respective arcuate portion, and a second, arcuate slot having a width equal to the diameter of the bore and adapted to slidingly engage the cylindrical portion, whereby, in use, each projection can disengage from its respective recess, during rotation about the other pivot projection and recess, with is arcuate and cylindrical portions sliding along the first and second arcuate slots, and, after commencement of rotation between a pivot projection and its associated recess, the arcuate portion engages the cylindrical bore, to prevent disengagement of that pivot projection and recess.

6. A mechanism as claimed in claim 1, wherein the biasing means comprises a latch member mounted on the door and arranged to be capable of engaging a stop member, and a biasing spring acting on the latch member, to urge it against a stop member, and thereby to urge the first and second pivot devices into engagement with the first and second pivot means.

7. A mechanism as claimed in claim 6, which includes a body member, with the latch member and the biasing spring being mounted on the body member, and with the first and second pivot devices also being mounted on the body member.

8. A mechanism as claimed in claim 7, wherein the latch member is pivotally mounted on a pivot shaft secured to the body member.

9. A mechanism as claimed in claim 8, wherein the latch member is pivotally mounted on an axis perpendicular to a plane of a door leaf in use.

10. A mechanism as claimed in claim 9, wherein the latch member is pivotally mounted between the first and second pivot devices.

11. A mechanism as claimed in claim 10, wherein the first and second pivot devices are (arranged to be) capable of disengagement from their respective first and second pivot means by movement generally in one radial direction, and wherein the biasing means exerts a force on the body member in the other radial direction.

12. A mechanism as claimed in claim 11, wherein the first and second devices are capable of disengagement from their respective first and second pivot means by movement generally in a radially outwards direction, and wherein the biasing means exerts a radially inwards force on the body member.

13. A mechanism as claimed in claim 12, wherein the latch member includes a first latch projection at one end thereof, for abutting the stop member, and wherein the biasing spring acts on the other end of the latch member.

14. A mechanism as claimed in claim 13, wherein the biasing spring comprises cup springs arranged in a row around a shaft.

15. A mechanism as claimed in claim 13, which further comprises a catch pivotally mounted on the body member, and including a catch projection, the latch member including a second latch projection for engagement with the catch projection, to retain the latch member in a cocked position.

16. A mechanism as claimed in claim 15, wherein the catch member includes the catch projection at one end thereof, and an acutating projection at the other end thereof for releasing the catch projection from the latch member.

17. A mechanism as claimed in claim 16, wherein a second biasing means is provided for urging the catch projection into engagement with the second latch projection.

18. A mechanism as claimed in claim 17, which includes a plunger slidably mounted in a bore of the body member and pivotally connected to the catch member, and wherein the second biasing means comprises a spring acting on the plunger.

19. A mechanism as claimed in claim 16, 17 or 18, whreein the actuating projection is provided at a radially inner end of the mechanism, and wherein the mechanism includes an operating projection, which contacts the actuating projection during assembly, to cause the catch member to release the latch member.

20. A mechanism as claimed in claim 12, wherein the pivot means comprise projections and the pivot devices comprise recesses in the body member.

21. A mechanism as claimed in claim 20, wherein each pivot projection comprises a cylindrical portion and an arcuate portion adjacent the cylindrical portion at a free end therof, and wherein each recess comprises a blind, cylindrical bore adapted to receive a respective arcuate projection, a first, arcuate slot adapted to receive a respective arcuate projection, and a second arcuate slot adapted to receive a respective cylindrical portion, the width of the arcuate slot being the same as the diameter of the cylinder bore.

22. A mechanism as claimed in claim 5 or claim 21, wherein each arcuate projection comprises radially inner and outer side surfaces centered on the other pivot projection, and each surfaces extending between the side surfaces, which end surfaces are extensions of corresponding parts of the associated cylindrical portion.

23. A mechanism as claimed in claim 6, 12 or 21, wherein the stop member is slidably mounted in the support plate for movement in a vertical direction and includes a sloping face, and wherein a spring means urges the stop member to a normal, extended position, whereby, in use, during assembly, the latch member can pass over the stop member with the latch member contacting said face of the stop member to displace the stop member to provide passage for the latch member.

24. A revolving door comprising a central shaft mounted for rotation about a vertical axis;

a plurality of door leaves; and, for each door leaf, two mechanisms as claimed in claim 1, 5 or 6, securing the respective door leaf to the central shaft, with one mechanism being provided at an upper end of the door and the other mechanism being provided at a lower end of the door, wherein at each of the lower and upper ends of the revolving door a single support plate is provided for all the door leaves, with each support plate including the first and second pivot means for the respective mechanisms.

25. A revolving door comprising a central shaft mounted for rotation about a central axis;

a plurality of door leaves; and, for each door leaf, two mechanisms as claimed in claim 12, 14 or 21, securing the respective door leaf to the central shaft, with one mechanism being provided at an upper end of the door and the other mechanism being provided at a lower end of the door, wherein at each of the lower and upper ends of the revolving door a single support plate is provided for all the door leaves, with each support plate including the first and second pivot means for the respective mechanisms.

26. A mechanism for mounting at one end of a door leaf of a collapsible revolving door including a plurality of door leaves which normally rotate together about a central axis, the mechanism comprising:

a support plate for rotation about said central axis of a revolving door, which support plate includes first and second spaced pivot means;

first and second pivot devices mountable on a door leaf for engaging the first and second spaced pivot means respectfully, the arrangement being such that, in use, either one of the first and second pivot devices can become disengaged from its respective pivot means to enable the door leaf to rotate about a pivot axis of the other one of said first and second pivot means, whereupon after commencement of such rotation the other of the first and second pivot devices cannot disengage from its respective pivot means; and biasing means for normally maintaining the first and second devices in engagement with the first and second pivot means, to retain the door leaf in a normal extended position;

wherein each of the first and second pivot means comprises a pivot projection, and each of the first and second pivot devices comprises a recess;

wherein each pivot projection comprises a cylindrical portion and, adjacent the cylindrical portion, an arcuate portion at a free end of the pivot projection; and wherein each recess correspondingly comprises a blind, shallow cylindrical bore adapted to engage a respective arcuate portion, a first arcuate slot adapted to engage a respective arcuate portion, and a second arcuate slot having a width substantially equal to the diameter of the bore and adapted to slidingly engage the cylindrical portion, whereby, in use, each projection can disengage from its respective recess, during rotation about the other pivot projection and recess, with its arcuate and cylindrical portions sliding along the first and second arcuate slots, and, after commencement of rotation between a pivot projection and its associated recess, the arcuate portion engages the cylindrical bore, to prevent disengagement of that pivot projection and recess.

27. A revolving door comprising a central shaft mounted for rotation about a vertical axis; a plurality of door leaves; and for each door leaf, two mechanisms as claimed in claim 26, securing the respective door leaf to the central shaft, with one mechanism being provided at an upper end of the door and the other mechanism being provided at a lower end of the door, wherein at each of the lower and upper ends of the revolving door a single support plate is provided for all the door leaves, with each support plate including the first and second pivot means for the respective mechanisms.

28. A mechanism for mounting at one end of a door leaf of a collapsible revolving door including a plurality of door leaves which normally rotate together about a central axis, the mechanism comprising:

a support plate for rotation about said central axis of a revolving door, which support plate includes first and second spaced pivot means;

first and second pivot devices mountable on a door leaf for engaging the first and second spaced pivot means respectfully, the arrangement being such that, in use, either one of the first and second pivot devices can become disengaged from its respective pivot means to enable the door leaf to rotate about a pivot axis of the other one of said first and second pivot means whereupon after commencement of such rotation, the other of the first and second pivot devices cannot disengage from its respective pivot means; and biasing means for normally maintaining the first and second devices in engagement with the first and second pivot means, to retain the door leaf in a normal extended position;

wherein the biasing means comprises a latch member mounted on the door and arranged to be capable of engaging a stop member, and a biasing spring acting on the latch member, to urge it against a stop member, and thereby to urge the first and second pivot devices into engagement with the first and second pivot means; and a body member with the latch member and the biasing spring being mounted on the body member, and with the first and second pivot devices also being mounted on the body member;

wherein the latch member is pivotally mounted on a pivot shaft secured to the body member, on an axis perpendicular to a plane of a door leaf in use between the first and second pivot devices;

wherein the first and second pivot devices are arranged to be capable of disengagement from their respective first and second pivot means by movement generally in a radially outwards direction, and wherein the biasing means exerts a radially inwards force on the body member;

wherein the pivot means comprise pivot projections, and the pivot devices comprise recesses in the body member;

wherein each pivot projection comprises a cylindrical portion and an arcuate portion adjacent the cylindrical portion at a free end thereof, and wherein each recess comprises a blind, cylindrical bore adapted to receive arcuate projection, a first arcuate slot adapted to receive a respective arcuate projection, and a second arcuate slot adapted to receive a respective cylindrical portion, the width of the arcuate slot being substantially the same as the diameter of the cylinder bore.

29. The mechanism of claim 26 or 28 wherein each arcuate projection comprises radially inner and outer side surfaces centered on the other pivot projection, and end surfaces extending between the side surfaces, which end surfaces are extensions of corresponding parts of the associated cylindrical portion.

30. The mechanism of claim 28 wherein the stop member is slidably mounted in the support plate for movement in a vertical direction and includes a sloping face, and wherein a spring means urges the stop member to a normal extended position, whereby in use, during assembly, the latch member can pass over the stop member with the latch member contacting said face of the stop member to displace the stop member to provide passage for the latch member.

31. A revolving door comprising a central shaft mounted for rotation about a central axis; a plurality of door leaves; and for each door leaf, two mechanisms as claimed in claim 28, securing the respective door leaf to the central shaft, with one mechanism being provided at an upper end of the door and the other mechanism being provided at a lower end of the door, wherein at each of the lower and upper ends of the revolving door a single support plate is provided for all the door leaves, with each support plate including the first and second pivot means for the respective mechanisms.

32. A mechanism for mounting at one end of a door leaf of a collapsible revolving door including a plurality of door leaves which normally rotate together about a central axis, the mechanism comprising:

a support plate for rotation about said central axis of a revolving door, which support plate includes first and second spaced pivot means;

first and second pivot devices mountable on a door leaf for engaging the first and second spaced pivot means respectfully, the arrangement being such that, in use, either one of the first and second pivot devices can become disengaged from its respective pivot means to enable the door leaf to rotate about a pivot axis of the other one of said first and second pivot means whereupon after commencement of such rotation, the other of the first and second pivot devices cannot disengage from its respective pivot means; and biasing means for normally maintaining the first and second devices in engagement with the first and second pivot means, to retain the door leaf in a normal extended position;

wherein the biasing means comprises a latch member mounted on the door and arranged to be capable of engaging a stop member, and a biasing spring acting on the latch member, to urge it against a stop member, and thereby to urge the first and second pivot devices into engagement with the first and second pivot means;

a body member with the latch member and the biasing spring being mounted on the body member, and with the first and second pivot devices also being mounted on the body member;

wherein the latch member is pivotally mounted on a pivot shaft secured to the body member, on an axis perpendicular to a plane of a door leaf in use between the first and second pivot devices;

wherein the first and second pivot devices are arranged to be capable of disengagement from their respective first and second pivot means by movement generally in a radially outwards direction, and wherein the biasing means exerts a radially inwards force on the body member;

wherein the latch member includes a first latch projection at one end thereof, for abutting the stop member, and wherein the biasing spring acts on the other end of the latch member; and a catch pivotally mounted on the body member, and including a catch projection, the latch member including a second latch projection for engagement with the catch projection, to retain the latch member on a cocked position.

33. The mechanism of claim 32 wherein the catch member includes the catch projection at one end thereof, and an actuating portion at the other end thereof for releasing the catch projection from the latch member.

34. The mechanism of claim 33 wherein a second biasing means is provided for urging the catch projection into engagement with the second latch projection.

35. The mechanism of claim 34 which includes a plunger slidably mounted in a bore of the body member and pivotally connected to the catch member, and wherein the second biasing means comprises a spring acting on the plunger.

36. The mechanism of claim 33, 34, or 35 wherein the actuating projection is provided at a radially inner end of the mechanism, and wherein the mechanism includes an operating projection, which contacts the actuating projection during assembly, to cause the catch member to release the latch member.

* * * * *

UNITED STATES PATENT AND TRADEMARK OFFICE

CERTIFICATE OF CORRECTION

PATENT NO. : 4,660,322

DATED : April 28, 1987

INVENTOR(S) : Dennis Lowe

It is certified that error appears in the above-identified patent and that said Letters Patent is hereby corrected as shown below:

In claim 1 at column 12, line 62, delete "." insert a --,--.

In claim 2 at column 13, line 10, change "adaptd" to --adapted--.

In claim 11 at column 13, line 62, delete ")" and "(".

In claim 19 at column 14, line 34, change "whreein" to --wherein--.

In claim 20 at column 14, line 40, after "comprise" insert --pivot--.

In claim 22 at column 14, line 55, change "each" to --end--.

In claim 28 at column 16, line 65, after "receive" insert --a respective--.

Signed and Sealed this

First Day of December, 1987

*Attest:*

DONALD J. QUIGG

*Attesting Officer*

*Commissioner of Patents and Trademarks*